US012209832B2

(12) United States Patent
Quinn

(10) Patent No.: US 12,209,832 B2
(45) Date of Patent: Jan. 28, 2025

(54) BOLT LOCK SAFETY DEVICE

(71) Applicant: Jesse Quinn, Prescott Valley, AZ (US)

(72) Inventor: Jesse Quinn, Prescott Valley, AZ (US)

( * ) Notice: Subject to any disclaimer, the term of this patent is extended or adjusted under 35 U.S.C. 154(b) by 0 days.

(21) Appl. No.: 18/236,912

(22) Filed: Aug. 22, 2023

(65) Prior Publication Data

US 2023/0408216 A1 Dec. 21, 2023

Related U.S. Application Data

(63) Continuation-in-part of application No. 17/473,958, filed on Sep. 13, 2021, now Pat. No. 11,732,983.

(51) Int. Cl.
*F41A 3/42* (2006.01)

(52) U.S. Cl.
CPC ..... *F41A 3/42* (2013.01)

(58) Field of Classification Search
CPC ..... F41A 3/42
See application file for complete search history.

(56) References Cited

U.S. PATENT DOCUMENTS

| | | | |
|---|---|---|---|
| 2,098,727 | A | 11/1937 | Lahti |
| 4,015,512 | A | 4/1977 | Feerick |
| 11,732,983 | B2 | 8/2023 | Quinn |
| 2009/0101000 | A1 | 4/2009 | Rawson-Harris |
| 2021/0348861 | A1 | 11/2021 | Tertin |

*Primary Examiner* — Michelle Clement
(74) *Attorney, Agent, or Firm* — Bycer & Marion, PLC; Matthew L. Bycer; Michael B. Marion

(57) ABSTRACT

A system and method for operating a semi-automatic firearm as a single-shot firearm by installing a bolt with a bolt lock safety device, wherein the bolt lock safety device extends beyond the outer face of the bolt when engaged preventing the firearm from automatically reloading. The bolt lock safety device can be disengaged to allow pulling the charging handle back to cause the bolt to move rearward exposing the firearm chamber to reload a cartridge.

20 Claims, 11 Drawing Sheets

BOLT LOCK SAFETY DEVICE

CLAIM OF PRIORITY

The present continuation-in-part application includes subject matter disclosed in, and claims priority to, U.S. patent application Ser. No. 17/473,958, filed Sep. 13, 2021, entitled "Bolt Lock Safety Device" (now U.S. Pat. No. 11,732,983) describing inventions made by the present inventor and incorporated herein by reference.

BACKGROUND OF THE INVENTION

1. Field of the Invention

The present invention relates to firearms and, more particularly, to a safety device used to modify the operation of a semi-automatic firearm model.

2. Description of Related Art

Conventionally, a semi-automatic firearm is operated using a bolt-action mechanism that allows for automatic reloading of the firearm after discharge (e.g., fired). A standard bolt in a semi-automatic firearm operates as a type of breech mechanism configured to automatically reload a cartridge (e.g., ammunition) into a chamber of a semi-automatic firearm where the breech of the breech mechanism is located near the rear opening of the chamber.

Generally, a cartridge of the semi-automatic firearm is chambered, from a magazine storing the ammunition, through the breech via the automatic spring action of the firearm. Upon discharge, the firing mechanism expels a projectile (e.g., round or bullet) from the cartridge, preloaded in the chamber, through the barrel of the firearm where the bullet exits through the muzzle of the barrel discharging the projectile. Conventionally, a breech block is a mechanism that seals the breech at the time the firearm is discharged. The breech block can slide a block across the face of the breech to seal and/or close the breech to seal the gases produced by the chemical reaction as the firing pin strikes a primer in the cartridge.

Generally, a bolt mechanism of a firearm includes a firing pin, a recoil spring (steadied by a guide rod), and an extractor (a spring-loaded mechanism). The firing pin slides back and forth within the bolt. As the firearm is discharged, the bolt moves back and forth within a receiver. The bolt is forced back in the receiver to allow recharging or rechambering a cartridge in the firearm. The function of reloading the firearm can be executed either (i) automatically with bolt-action or (ii) manually by a user. For example, when manually reloading the firearm, a charging handle of a bolt can be manually pulled toward the rear of the firearm to load a cartridge. A charging handle can be integrated or coupled to the bolt. The action of pulling back the charging handle of the firearm cocks the internal hammer of the firearm mechanism and compresses the recoil spring in preparation for discharge that occurs by pulling the trigger of the firearm. The firing pin strikes a cartridge in the magazine within the chamber causing an ignition to propel the projectile from the firearm.

After the firearm in discharged, the bolt is forced rearward by the force of the explosion where an extractor removes the empty (e.g., spent cartridge) by ejecting the casing and automatically inserting a new cartridge from the magazine in the chamber ready for the next discharge. Upon discharge, gases, generated by a chemical reaction during the discharge of the firearm, are dispelled from the firearm. Once the firearm is chambered or reloaded with a cartridge, the firearm can be discharged.

SUMMARY OF IE INVENTION

The present invention is directed to a bolt lock safety device 100 (e.g., a firearm bolt lock safety device) configured to be installed as part of a bolt 200 that is modified with a bolt lock safety device 100. Bolt lock safety device 100 includes an adjustable bolt lock 130 and a lock adjuster 140, where the adjustable bolt lock 130 operates as a type of safety device in the shape of a bar that when engaged is configured to extend outward past the surface of the bolt 200. Adjustable bolt lock 130 is engaged in a standard position when the bar of the adjustable bolt lock is extended outward. Lock adjuster 140 can also be used as a charging handle when the charging handle is used to manually reload the chamber of the firearm. Bolt 200, adjustable bolt lock 130, and lock adjuster 140 (e.g., charging handle) are illustrated in greater detail below in connection with FIGS. 1-6.

When adjustable bolt lock 130 of the bolt is engaged and the semi-automatic firearm (e.g., firearm) is discharged, the bar of adjustable bolt lock 130 prevents bolt 200 from fully recoiling by stopping bolt 200 against the receiver. Adjustable bolt lock 130 can prevent the semi-automatic firearm from automatically reloading the chamber with a new cartridge. Similarly, when the bar of the adjustable bolt lock 130 is disengaged, the bar is flush with the surface of bolt 2M allowing bolt 200 of the semi-automatic firearm to fully recoil and reload the chamber.

An objective of bolt lock safety device 100 can be to operate a semi-automatic firearm as a single shot firearm when the bar of the adjustable bolt lock 130 is engaged in the standard position. Similarly, when the bar of adjustable bolt lock 130 is disengaged in a non-standard position, the bar is positioned flat against the surface of bolt 200. Bolt lock safety device 100 includes a method for operating the semi-automatic firearm as a single-shot firearm that begins with installing bolt 200, as modified by the bolt lock safety device 100, in the firearm. Installation of bolt 200 in the semi-automatic firearm allows the firearm to be transformable depending on whether bolt lock safety device 100 is positioned in a standard position or a non-standard position.

Bolt lock safety device 100 engaged in the standard position can include extending the bar of bolt lock safety device 100 beyond a face of bolt 200 preventing the semi-automatic firearm from automatically reloading. Bolt lock safety device 100 stops bolt 200 from recoiling past a distance enough to expose a firearm chamber in order for the firearm to reload when bolt lock safety device 100 is engaged. Bolt lock safety device 100 can be secured into a locked position extending beyond the face of the bolt by screwing the lock adjuster 140 in a first direction until the adjustable bolt lock 130 extends beyond a face of the bolt.

Adjustable bolt lock 130 secured in the standard position can prevent the semi-automatic firearm from reloading the chamber as the bar of the adjustable bolt lock 130 can stop bolt 200 against the receiver or frame of the firearm. In order to reload the semi-automatic firearm engaged in the standard position, the charging handle (e.g., lock adjuster 140) can be manually pulled backward and the bar of the adjustable bolt lock 130 is pushed inward so as to be flush with side surface of the bolt exposing the chamber opening to allow ammunition to be loaded in the chamber. Upon releasing the charging handle, the bolt lock safety device 100 can return the adjustable bolt lock 130 to the standard position preventing further automatic reloading of the firearm via spring bias action. The semi-automatic firearm may be discharged as long as ammunition is loaded in the chamber whether the bolt lock safety device 100 is engaged or disengaged. When the firearm is fired with the bolt lock safety device in standard position, the bar of adjustable bolt lock 130 prevents full recoil of bolt 200 preventing automatic reload.

Securing bolt lock safety device 100 into the standard position of extending beyond the face of the bolt can be obtained by screwing (e.g., tightening) the lock adjuster 140 in a first direction until the bar of the adjustable bolt lock extends beyond a face of the bolt. Discharging the semi-automatic firearm can cause spring pressure from a lock return spring 160 to pivot the bar of adjustable bolt lock 130 outwards forcing adjustable bolt lock 130 to contact a receiver preventing full recoil of the bolt.

Similarly, disengaging the bar of adjustable bolt lock 130 can include unscrewing (e.g., untightening) lock adjuster 140 in a second direction until adjustable bolt lock 130 is flush with a surface of bolt 20. Disengaging bolt lock safety device 100 can include untightening lock adjuster 140 in bolt 200 to rotate or pivot the bar of adjustable bolt lock 130 to lay flush with bolt 200. When the bar of adjustable bolt lock 130 is flush with bolt 200 of the semi-automatic firearm, bolt 200 is unimpeded by the extension of the bar and the semi-automatic firearm can be automatically reloaded.

When bolt lock safety device 100 is engaged, the semi-automatic firearm also can be reloaded manually by pulling the charging handle rearward exposing the chamber of the firearm to reload a cartridge. As the charging handle is pulled back, the bar of adjustable bolt lock 130 in the outward position is pushed back to lay flush with bolt 200 allowing bolt 20W to resume loading the chamber. Upon release of the charging handle, the bar of adjustable bolt lock 130 returns to the standard position. Bolt lock safety device 100 also can force gas emissions out of a barrel of the firearm upon discharge of the firearm.

An embodiment of bolt 200, modified with bolt lock safety device 100, can include using a lock safety screw 150 to lock or secure bolt safety device 100 in a standard position. Another objective of bolt lock safety device 130 can be to lock or secure the semi-automatic firearm rendering the firearm inoperable when lock safety screw 150 secures or locks the bar of adjustable bolt lock 130 in the standard position. Lock safety screw 150 can be inserted through a lock adjuster aperture 145 of lock adjuster 140 and into a safety screw hole 180 in bolt 200. Inserting lock safety screw 150 can lock the bar of adjustable bolt lock 130 in place and render the semi-automatic firearm inoperable. When lock safety screw 150 is tightened into bolt 200 and the chamber of the semi-automatic firearm is empty, the semi-automatic firearm can no longer be discharged or operated as a firearm. Similarly removing lock safety screw 150 from lock adjuster aperture 145 of lock adjuster 140 from safety screw hole 180 of bolt 200 can unlock adjustable bolt lock 130 and render the semi-automatic firearm operable.

Another objective of the bolt lock safety device 100 can include decreasing the level of noise and gas discharge when the bolt lock safety device 100 is engaged in standard position.

Components of bolt lock safety device 100 may include an adjustable bolt lock 130 and a lock adjuster 140 (charging handle). Bolt 200 modified by bolt lock safety device 100 can include a top surface, a bottom surface, and a side surface. The top surface can interface with a receiver. The bottom surface can be located parallel to and opposite from the top surface. The side surface can be orthogonal to and between the top surface and the bottom surface. The side surface can include a bolt lock longitudinal recess 110 sized to accommodate adjustable bolt lock 130.

Adjustable bolt lock 130 can be fitted into a bolt lock longitudinal recess 110 located on the side surface of bolt 200 to be flush with the side surface when the bar of adjustable bolt lock 130 is disengaged. Adjustable bolt lock 130 can include a top surface, a bottom surface, and an outer surface. The top surface and the bottom surface can be in the shape of a bar and/or another suitable shape. The top surface can be parallel to a top surface of the bolt and a bottom surface can be parallel to the bottom surface of the bolt. The adjustable bolt lock outer surface may be orthogonal to the top surface of the bolt.

Lock adjuster 140 can be coupled to bolt 200 and configured to impart a rotation to the bar of adjustable bolt lock 130 to pivot the bar into an engaged standard position. Lock adjuster 140 can impart another rotation of the bar of adjustable bolt lock 130 to disengaged the bar from the standard position where the adjustable bolt lock outer surface of the adjustable bolt lock 140 is generally flush with the side surface of the bolt.

BRIEF DESCRIPTION OF THE DRAWINGS

The present invention will be described with greater specificity and clarity with reference to the following drawings, in which.

DETAILED DESCRIPTION OF THE PREFERRED EMBODIMENT

Figure 1:
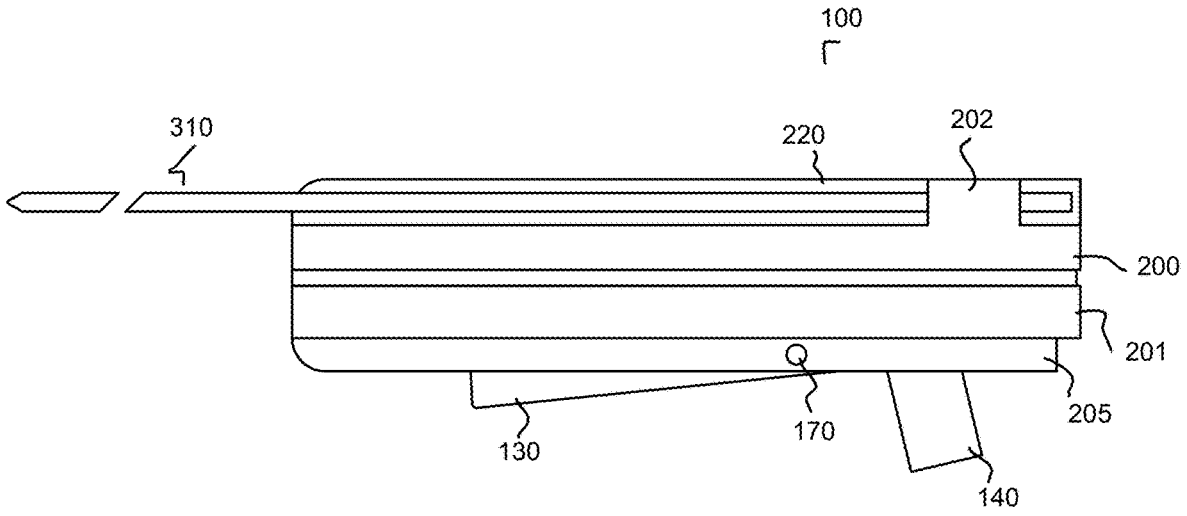
FIG. 1 illustrates a top view of an exemplary bolt lock safety device, according to an embodiment of the present invention.

Non-limiting embodiments of the present disclosure will be further described by referring to the accompanying drawings. It should be understood that the embodiments illustrated in the drawings are for description of the invention only and shall not be construed as any limitation to the present disclosure. The scope of the invention would rather be defined by the appended claims.

It should be understood that the accompanying drawings are merely used to illustrate embodiments of the present disclosure and are not necessarily drawn to scale.

A disclosed embodiment of the invention can include a bolt 200 equipped with a bolt lock safety device 100 (e.g., firearm bolt lock safety device) that can be installed in place of a standard bolt in a standard bolt-action firearm. Bolt 200, equipped with bolt lock safety device 100, can be a single apparatus that is generally installed or uninstalled as a bolt mechanism in a firearm, such as a semi-automatic firearm. Bolt lock safety device 100 can be secured in bolt 200 by installing particular components of bolt lock safety device directly into the bolt, such components can include a lock pivot pin 170, a lock return spring 160, and a lock adjuster 140 in bolt 200.

Conventionally, a standard bolt-action firearm is a type of breech mechanism used for a semi-automatic firearm that can repeatedly load cartridges after each discharge of the firearm until a magazine is fully spent and/or the user stops discharging the firearm. A semi-automatic firearm discharges a single shot at a time. The standard bolt function recoils automatically after discharge allowing the firearm to reload a cartridge from the magazine in preparation for the next discharge of the firearm. The semi-automatic firearm can repeatedly discharge each cartridge one after another based on an automatic reload capability.

By installing bolt 200, equipped with bolt lock safety device 100, the semi-automatic firearm can be discharged by a single shot at a time without an automatic reload capability when bolt lock safety device 100 is engaged in the standard position. When bolt safety lock 100 is engaged, adjustable bolt lock 130 can prevent bolt 200 from fully recoiling rearward after discharge blocking the semi-automatic firearm from automatically reloading the next cartridge from the magazine.

When bolt safety lock 100 is in the standard position, a portion or a bar of bolt lock safety device 100 extends beyond the face of bolt 200 preventing the bolt from recoiling rearward interrupting the automatic reload sequence of the firearm after discharge. When the user intends to load another cartridge while bolt lock safety device 100 extends beyond the face of the bolt, the user can manually pull the charging handle rearward to allow the next cartridge to load in the chamber. When bolt safety lock device 100 is engaged in the standard position, the semi-automatic firearm can be discharged as long as a cartridge is chambered.

The disclosed embodiment can include a method for operating a semi-automatic firearm as a single-shot firearm. Bolt lock safety device 100 can include an adjustable bolt lock 130 and a lock adjuster 140. In the disclosed embodiment, bolt 200 further includes a return spring cavity 120 coupled at the proximal end of a bolt lock longitudinal recess 110. Return spring cavity 120 can enclose a lock return spring 160 coupled to bolt 200 within bolt lock longitudinal recess 110, where lock return spring 160 can provide spring tension force to pivot adjustable bolt lock 130 into the standard position. Adjustable bolt lock 130 is coupled to bolt 200 via a lock pivot pin 170. Lock pivot pin 170 can be set transverse and within bolt lock longitudinal recess 110, lock pivot pin 170 can be set through a pivot pin lock aperture 171 of adjustable bolt lock 130 and through a pivot pin bolt aperture 172 of bolt 200 providing an axis to allow adjustable bolt lock 130 to rotate partially out of bolt lock longitudinal recess 110 when lock adjuster 140 is engaged.

The disclosed embodiment can include bolt lock safety device 100 extending beyond a face of the bolt, when engaged, preventing the firearm from automatically reloading. Bolt lock safety device 100 can stop bolt 200 from recoiling past a distance enough to expose a chamber in order for the firearm to reload. During a manual reload, the disclosed embodiment further includes manually pulling a charging handle back to cause bolt 200 to move rearward exposing the firearm chamber to reload a next cartridge.

Adjustable bolt lock 130 can be rotated by lock pivot pin 170 to lay flush with bolt 200 allowing the bolt to move back into a forward position in the firearm when the adjustable bolt lock is disengaged. Lock adjuster 140 can be used as a charging handle when the user intends to manually reload the firearm while the adjustable bolt lock is engaged in the standard position. Further, upon release of the charging handle used to manually reload the firearm, adjustable bolt lock 130, via the force of a lock return spring 160, can be returned to the standard position extending beyond the face of bolt 200.

The disclosed embodiment of bolt lock safety device 100, while engaged in the standard position, can (i) prevent automatic reloading of ammunition after a semi-automatic firearm is discharged and (ii) convert the activity of reloading a next round of ammunition in the chamber to a manual operation.

The disclosed embodiment can include using lock adjuster 140 to engage and/or disengage bolt lock safety device 100. Lock adjuster 140 can be a knob or a handle. When lock adjuster 140 is not engaged in standard position, the exterior surface of adjustable bolt lock 130 is generally flush with the side surface 230 of bolt 200. Turning lock adjuster 140 in a counterclockwise direction (as viewed from above) causes adjustable bolt lock 130 to pivot outward beyond side surface 230 of bolt 200. When adjustable bolt lock 130 is engaged, the bar of adjustable bolt lock 130 extended outward can act as a stop and/or a blocking point 132 that impedes a rearward recoil motion of bolt 200 against the receiver after discharging a round from the chamber. The disclosed embodiment can provide a type of safety function when bolt lock safety device 100 is engaged by keeping the chamber empty effectively locking the firearm from being discharged unintentionally.

Adjustable bolt lock 130 can be fitted into a bolt lock recess 110 in bolt 200, lock adjuster 140 can be fitted through a lock adjuster aperture 145 of adjustable bolt lock 130. Lock safety screw 150 can be fitted into a safety screw hold 180 to bolt 200. Lock return spring 160 can be fitted into a return spring cavity 120 in bolt lock longitudinal recess 110. Lock pivot pin 170 can be fitted through a pivot pin lock aperture 171 of adjustable bolt lock 130 and through pivot pin bolt aperture 172 located on bolt 200.

Bolt lock safety device 100 further can decrease the level of noise generated from a chemical combustion reaction upon discharge of the firearm. When the bolt lock safety device 100 is engaged, high-velocity gases near the bolt can be forced forward out of the barrel also reducing the level of noise from the discharge. In the disclosed embodiment, the noise level can further be reduced when the bolt lock safety device 100 is engaged when the firearm is equipped with a suppressor.

In the disclosed embodiment, bolt 200 can include a top surface 201 for interfacing with a receiver, a bottom surface 203 located parallel to and opposite from the top surface 201, and a side surface 230 where the side surface 230 is orthogonal to and between top surface 201 and bottom surface 203, where the side surface 230 includes a bolt lock longitudinal recess 110 that can accommodate adjustable bolt lock 130. Bolt 200 includes a return spring cavity 120 coupled to the distal end of the bolt lock longitudinal recess 110. Return spring cavity 120 can be coupled to bolt 200 and adjustable bolt lock 130. Bolt 200 is coupled to a firing pin and a guide rod system 310 (a guide rod and a recoil spring), where the firing pin is fitted in a firing pin slot 210 in bolt 200. Bolt 200 can include an extractor 320 and firing pin stop hole 330.

Adjustable bolt lock 130 includes a top surface parallel to the top surface 201 of bolt 200 and a bottom surface parallel to bottom surface 203. Further, an adjustable bolt lock outer surface is orthogonal to the top surface of adjustable bolt lock 130 and a lock adjuster aperture 145 (e.g., lock adjuster horizontal channel) extends from the adjustable bolt lock outer surface through the adjustable bolt lock 130. Adjustable bolt lock 130 is coupled to bolt 200 via a lock pivot pin 170, where lock pivot pin 170 is fitted through pivot pin lock aperture 171 and pivot pin bolt aperture 172. Lock pivot pin 170 allows adjustable bolt lock 130 to move in and/or out of bolt lock longitudinal recess 110 when adjustable bolt lock 130 is engaged and/or disengaged. Adjustable bolt lock 130 includes a safety screw aperture 180 for insertion of a lock safety screw 150.

Lock adjuster 140 is inserted through lock adjuster aperture 145, where lock adjuster 140 is coupled to bolt 200 and configured to impart a rotation to adjustable bolt lock 130 to position adjustable bolt lock 130 in a standard position. Similarly, the adjustable bolt lock outer surface of adjustable bolt lock 130 is flush with the side surface 230 of bolt 200 when disengaged.

Lock safety screw 150 can be fitted through safety screw hole 180 through lock adjuster 140. Bolt 200 can include a safety screw hole 180 adapted to receive a lock safety screw 150, the safety screw hole 180 set along a distal end of the bolt 200. Lock adjuster 140 includes a lock adjuster aperture 145 with a traverse channel through which the lock safety screw fits and affixes a relative position of a distal end of the lock adjuster to the bolt. Lock adjuster 140 includes access to safety screw hole 180 where lock safety screw 150 can be inserted through lock adjuster aperture 145 through the lock adjuster 140 and into bolt 200. Lock safety screw 150 can be inserted through lock adjuster aperture 145 through lock adjuster 140 and into the bolt 200. The insertion of lock safety screw 150 locks adjustable bolt lock 140 in place, and renders the semi-automatic firearm inoperable. Lock safety screw 150 can be removed from the lock adjuster 140. The removal of lock safety screw 150 unlocks adjustable bolt lock 140, and renders the semi-automatic firearm operable.

Turning to the drawings, FIG. 1 illustrates a top view of an exemplary bolt lock safety device 100, according to an embodiment of the present invention. For purposes of clarity, adjustable bolt lock 130 is shown rotated outward extended beyond the side surface 230 of bolt 200. As shown, pivot pin 170 allows adjustable bolt lock 130 to pivot outward out of bolt lock longitudinal recess 110 when lock safety screw 150 located in lock adjuster 140 is engaged. A partial top view of the exterior portions or parts of an exemplary semi-automatic firearm shows a top surface 201, a top surface tab 202, and a top edge 205 of bolt 200. Also shown is a firing pin slot 210 where the firing pin engages with the round causing the round to be discharged upon discharging the semi-automatic firearm. Guide rod and recoil spring system 310 is configured to move forward and backward each time the firearm is discharged encased in guide rod cavity 220. Such an action of resetting the firearm can be blocked or stopped when adjustable bolt lock 130 is engaged in a standard position. Additionally, as shown, is the dual function of lock adjuster 140 to be used to engage or secure adjustable bolt lock 130 and/or used as a charging handle to pull backward to allow loading for a subsequent round in the firing chamber.

Figure 2:
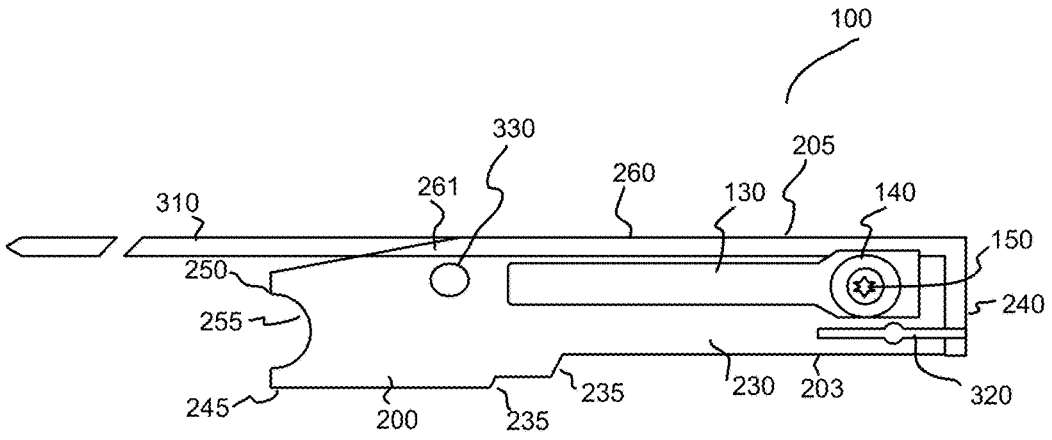
FIG. 2 illustrates a side view of an exemplary bolt lock safety device, according to an embodiment of the present invention.

Referring to the drawings. FIG. 2 illustrates a side view of an exemplary bolt lock safety device 100, according to an embodiment of the present invention. For purposes of clarity, a partial view of bolt lock safety device 100 illustrates a side view of the device without indicating whether adjustable bolt lock 130 is engaged or disengaged. As shown, side surface 230 is orthogonal to top edge 205. Ramp 261 and platform 260 are shown from a side view comprising an edge of side surface 230. Platform 260 meets front face 240 at a right angle. Front face 240 meets side edge 245 at an opposite right angle from platform 260. Side edge 245 travels along a generally parallel plane to top surface 201 and is orthogonal to bottom surface 203. Side edge 245 can contain at least one bevel edge 235. Side edge 245 is coupled to back 250, opposite of front face 240. The length between front face 240 and back 250 defines the length of side edge 245. The space between front face 240, side edge 245, ramp 261, platform 260, and back 250 define the space of side surface 230. Back 250 preferably also contains a radius 255. Side surface 230 contains a firing pin stop hole 330. Firing pin stop hole 330 is situated near back 250 in a position on a plane orthogonal to and with access to firing pin slot 210 but away from the activity of adjustable bolt lock 130 so as not to hinder the movement of adjustable bolt lock 130. Adjustable bolt lock 130 is situated in lock recess 110 which depresses into side surface 230 in the shape of adjustable bolt lock 130. Protruding out of adjustable bolt lock 130 and is charging handle 140 which can contain removable lock safety screw 150. Also located on side surface 230 is extractor 320 which removes casings from previously expended rounds in order to vacate the chamber for reloading of subsequent rounds.

Figure 3:
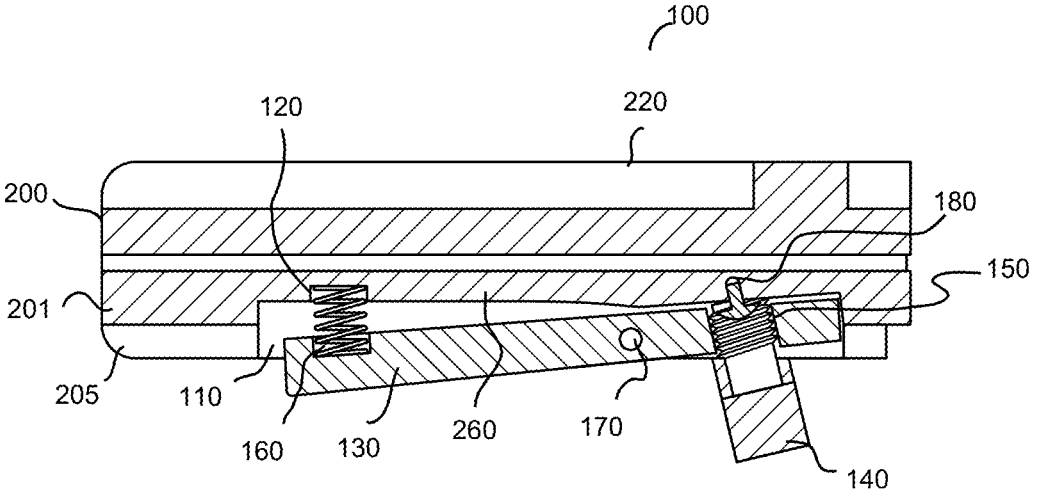
FIG. 3 illustrates a top cutaway view of an exemplary bolt lock safety device, illustrating internal mechanisms.
Figure 5:
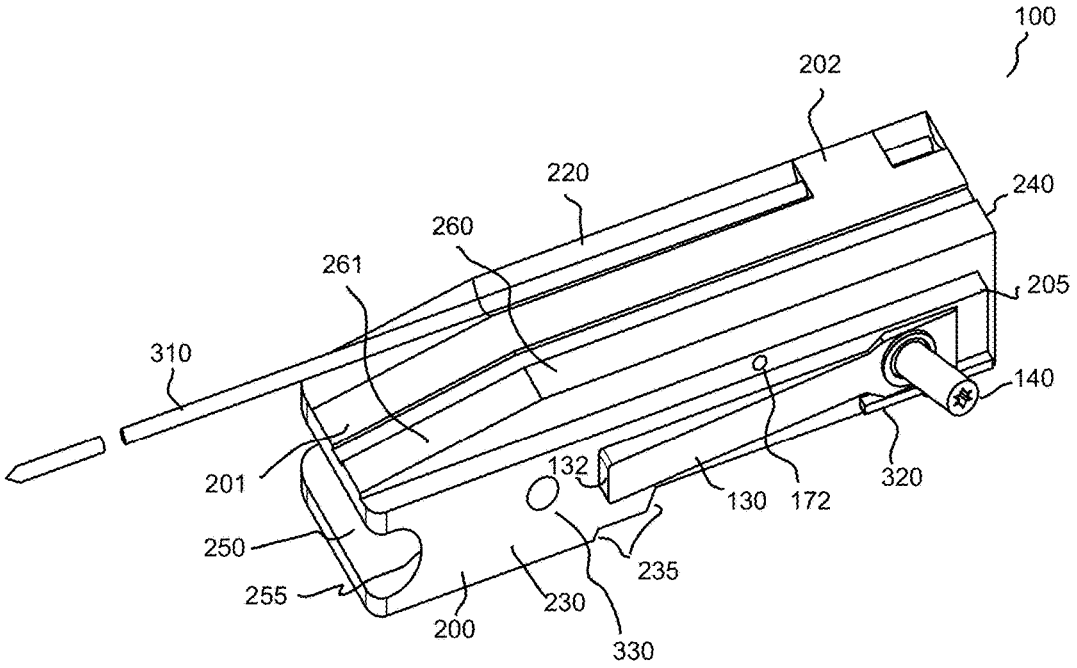
FIG. 5 illustrates a top perspective view of an exemplary bolt lock safety device, according to an embodiment of the present invention.

Turning to the drawings. FIG. 3 illustrates a top cutaway view of an exemplary bolt lock safety device 100, illustrating internal mechanisms. For purposes of clarity, adjustable bolt lock 130 is shown rotated outward extended beyond the side surface 230, as shown in FIG. 2 of the bolt 200, where a partial view of bolt lock safety device 100 additionally illustrates top surface 201 contain a firing pin slot 210, as shown in FIG. 1, top surface tab 202, and guide rod cavity 220, among other features. Top surface 201 can be planar, or, alternatively, can be ramped to produce bolt platform ramp 261 and platform 260. Firing pin slot 210 resembles a cavity through the center or near-center of top surface 201. The firing pin slot 210 can travel through platform ramp 261 and platform 260, thereby creating a slot through ramp 261 and platform 260, as shown in FIG. 5. Guide rod cavity 220 travels through an edge of top surface 210 planarly opposite to and parallel to top edge 205 and orthogonal to side surface 230. Guide rod cavity 220 is equipped with a guide rod and recoil spring 310 (not pictured). Bolt edge 205 is situated orthogonal to bolt surface 230, as shown in FIG. 1. Top edge 205 resembles a step-edge parallel to top surface 201 wherein a pivot pin bolt aperture 172 resides, as shown in FIG. 5. One end of lock return spring 160 is stationed in return spring cavity 120 and the other end is attached near the end of adjustable bolt lock 130 to assist with pushing out adjustable bolt lock 130 when engaged as part of bolt lock safety device 1M. Bolt lock longitudinal recess 110 shows the activity of lock return spring 160 when adjustable bolt lock 130 is engaged. Also shown is a top cutaway view of lock pivot pin 170 located on adjustable bolt lock 130 near lock adjuster 140, wherein lock safety screw 150 is shown screwed into safety screw hole 180.

Figure 4:
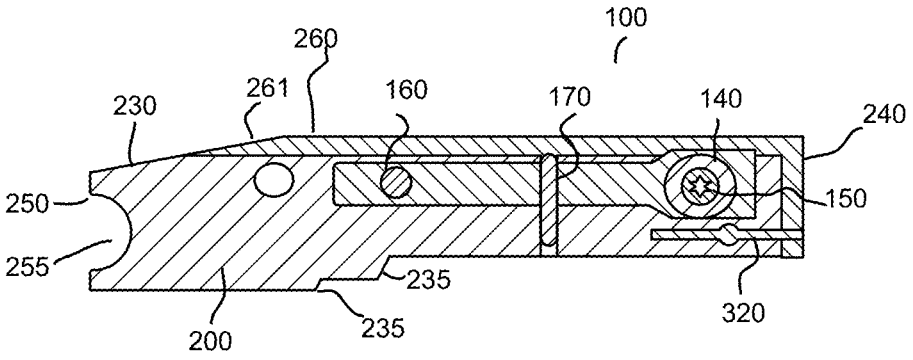
FIG. 4 illustrates a side cutaway view of an exemplary bolt lock safety device, illustrating internal mechanisms.

Referring to the drawings, FIG. 4 illustrates a side cutaway view of an exemplary bolt lock safety device 100, illustrating internal mechanisms. The partial view of bolt lock safety device 100 additionally illustrates adjustable bolt lock 130 fastened to bolt 200 when lock safety screw 150 within lock adjuster 140 is tightened that can cause adjustable bolt lock 130 to pivot outward using lock pivot pin 170. Partial cutaway view of side surface 230, bevel edges 235, a front face 240, a back 250, a radius 255, a platform 260, and a platform ramp 261 of bolt 200 additionally shows how bolt lock safety device 100 is integrated within bolt 200. Lock return spring 160 is situated in bolt lock longitudinal recess 110 as part of adjustable bolt lock 130. Also, shown is a side cutaway view to extractor 320 and firing pin stop hole 330.

Turning to the drawings, FIG. 5 illustrates a top perspective view of an exemplary bolt lock safety device 100, according to an embodiment of the present invention. For purposes of clarity, adjustable bolt lock 130 is shown rotated outward extended beyond the side surface 230 of the bolt 200, where a partial perspective view of bolt lock safety device 100 additionally illustrates top view orthogonal to a side view of bolt lock safety device 100. Adjustable bolt lock 130 is shown in an engaged mode indicating the knob on lock adjuster 140 was tightened causing adjustable bolt lock 130 to pivot outward beyond side surface 230 of bolt 200. As shown, top surface 201 and top surface tab are orthogonal to side surface 230 of bolt 200. Top edge 205 is parallel to front face 240 and guide rod cavity 220 within a guide rod aperture 222, where guide rod and recoil spring 310 is shown encased in guide rod cavity 220. Pivot pin bolt aperture 172 is located on top edge 205. Where bevel edges 235 are parallel to side surface 230. As shown, in a top perspective view, back 250 and radius 255 located near the rear of bolt 200. Platform 260 and platform ramp 261 are parallel to top surface 201. As shown below lock adjuster 140 located on bolt 200 is extractor 320. Located parallel to side surface 230 is firing pin stop hole 330 of bolt 200.

Figure 6:
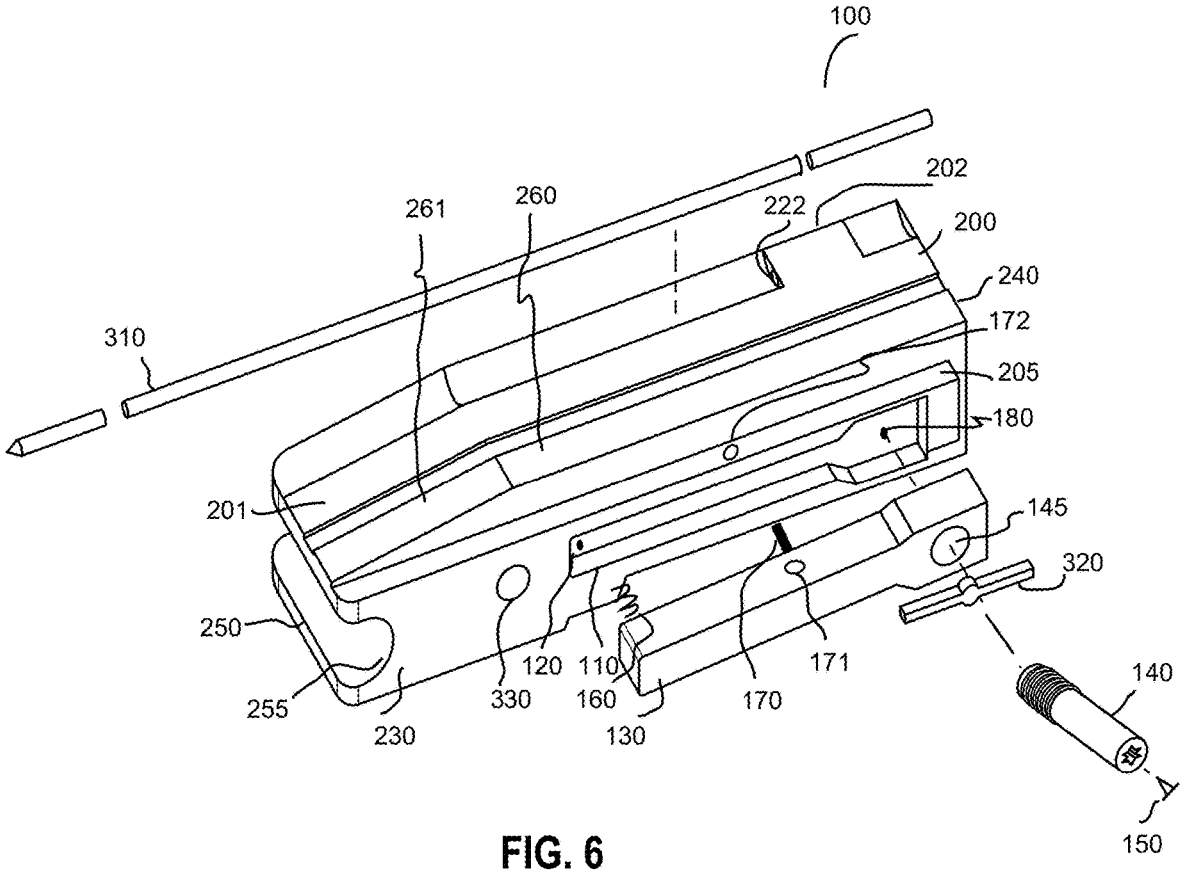
FIG. 6 illustrates a top perspective exploded view of an exemplary bolt lock safety device, according to an embodiment of the present invention.

Referring to the drawings, FIG. 6 illustrates a top perspective exploded view of an exemplary bolt lock safety device 100, according to an embodiment of the present invention. The partial exploded view of bolt lock safety device 100 additionally illustrates top view orthogonal to a side view of bolt lock safety device 100 in greater detail. Additionally, adjustable bolt lock 130 includes a lock pivot pin 170. Adjustable bolt lock 130 further includes a pivot pin lock aperture 171 fitted for lock pivot pin 170 associated with a pivot pin bolt aperture 172 to receive lock pivot pin 170 in bolt 200. Adjustable bolt lock 130 also includes a lock adjuster aperture 145 where lock safety screw 150 can be tightened or untightened as part of for lock adjuster 140 in safety screw hole 180 in bolt 200. Lock adjuster 140 includes a knob at the end of the part that is used to manually engage or disengage the bolt lock safety device 100. As shown in exploded view is top surface 201, top surface tab 202, platform 260, platform ramp 261, are in parallel with top edge 205. Bolt lock longitudinal recess 110 houses lock return spring 160 within return spring cavity 120. Guide rod and recoil spring 310 is shown as one piece where the recoil spring encases the guide rod, where guide rod and recoil spring 310 is suitably fitted in guide rod aperture 222 and guide rod cavity 220. Front face 240 is orthogonal to side surface 230 and where back 250 and radius 255 are shown in the read of bolt 200, where firing pin stop hole 330 is shown on side surface 230.

Figure 7:
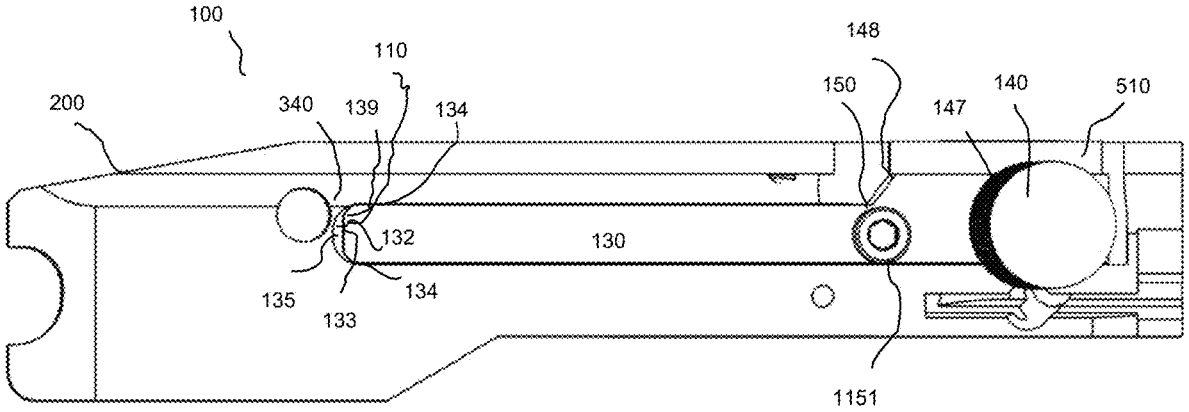
FIG. 7 illustrates a side view of a bolt lock safety device, according to an alternate embodiment of the present invention.
Figure 8:
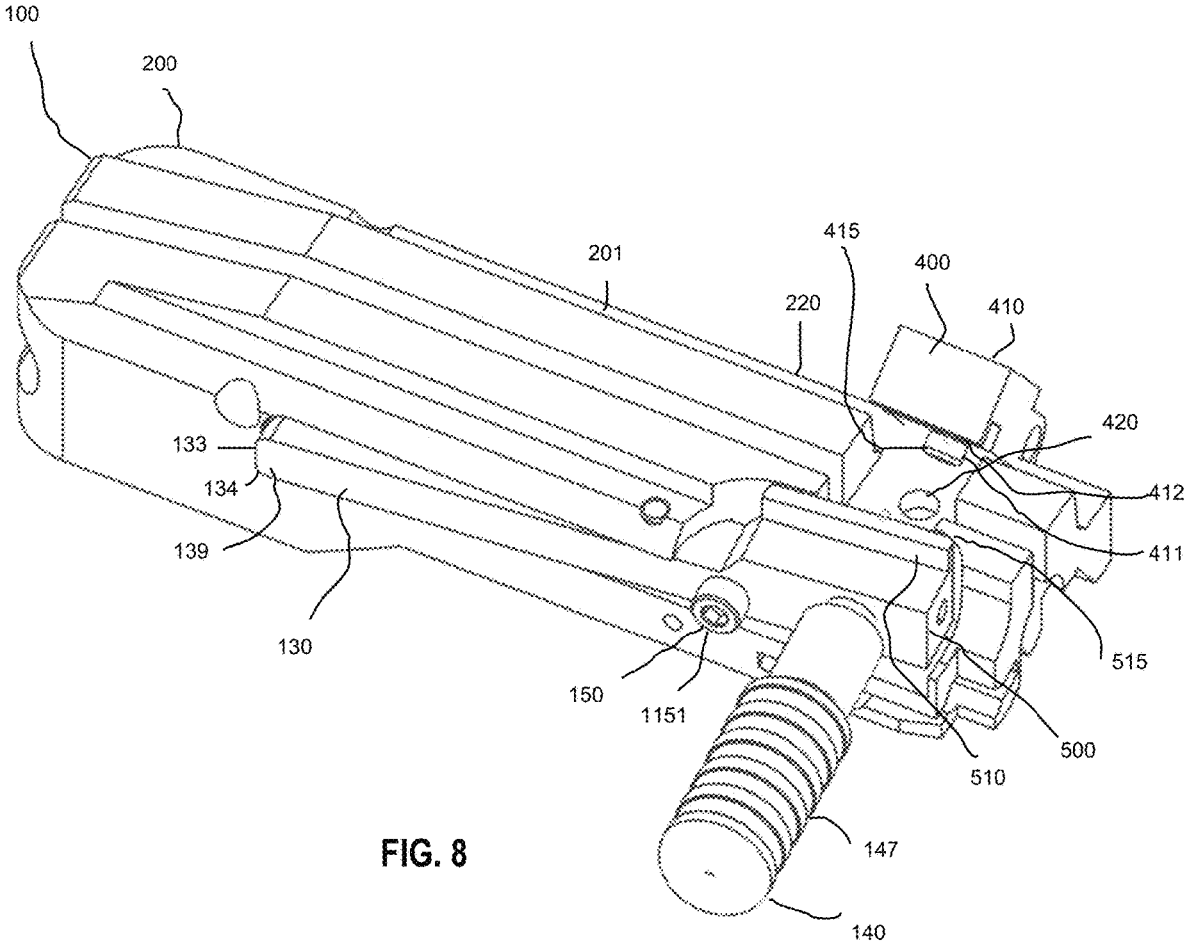
FIG. 8 illustrates a top perspective view of a bolt lock safety device with the guide rod partially removed, according to an alternate embodiment of the present invention.
Figure 9:
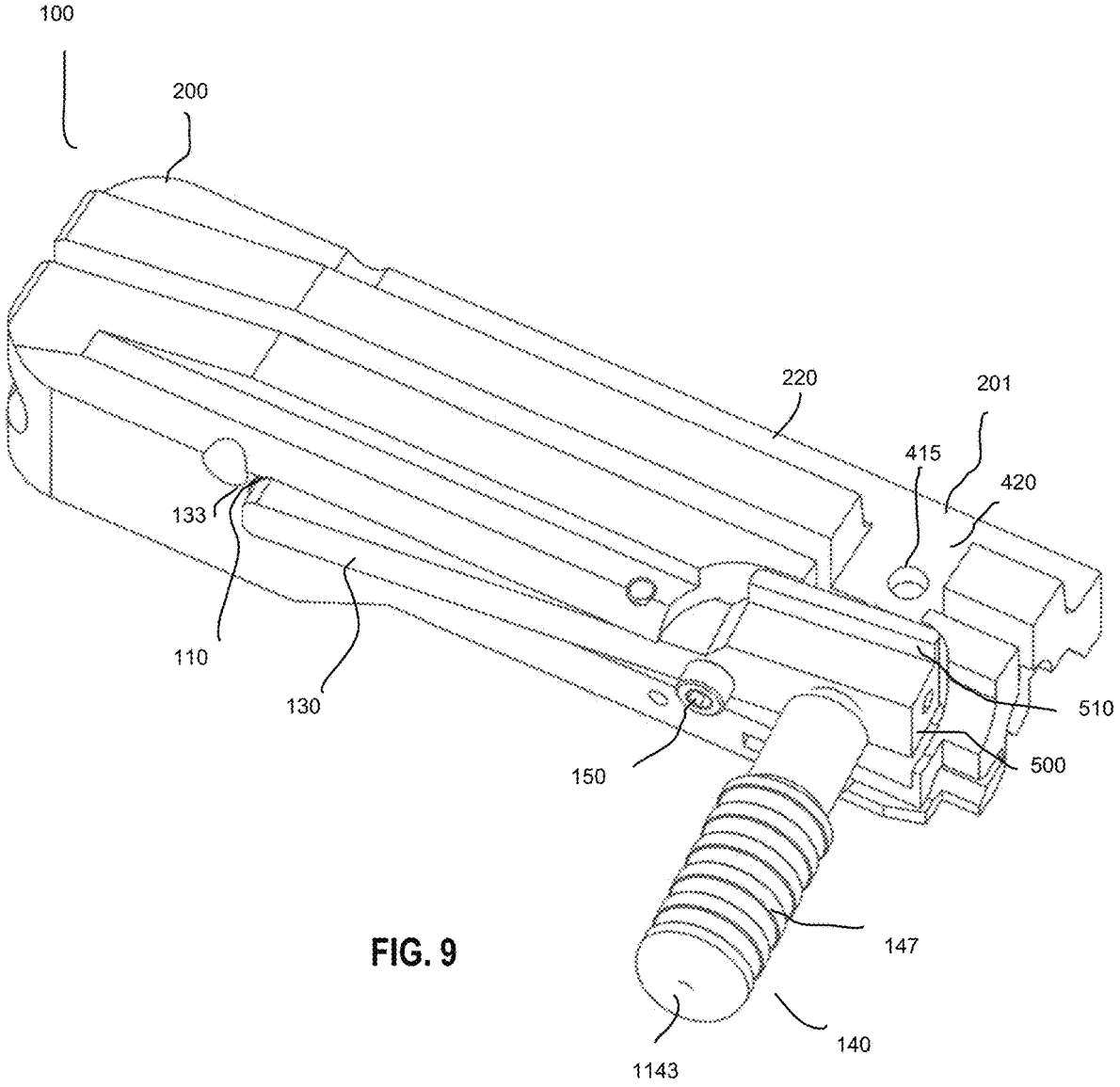
FIG. 9 illustrates a top perspective view of a bolt lock safety device without a guide rod, according to an alternate embodiment of the present invention.
Figure 10:
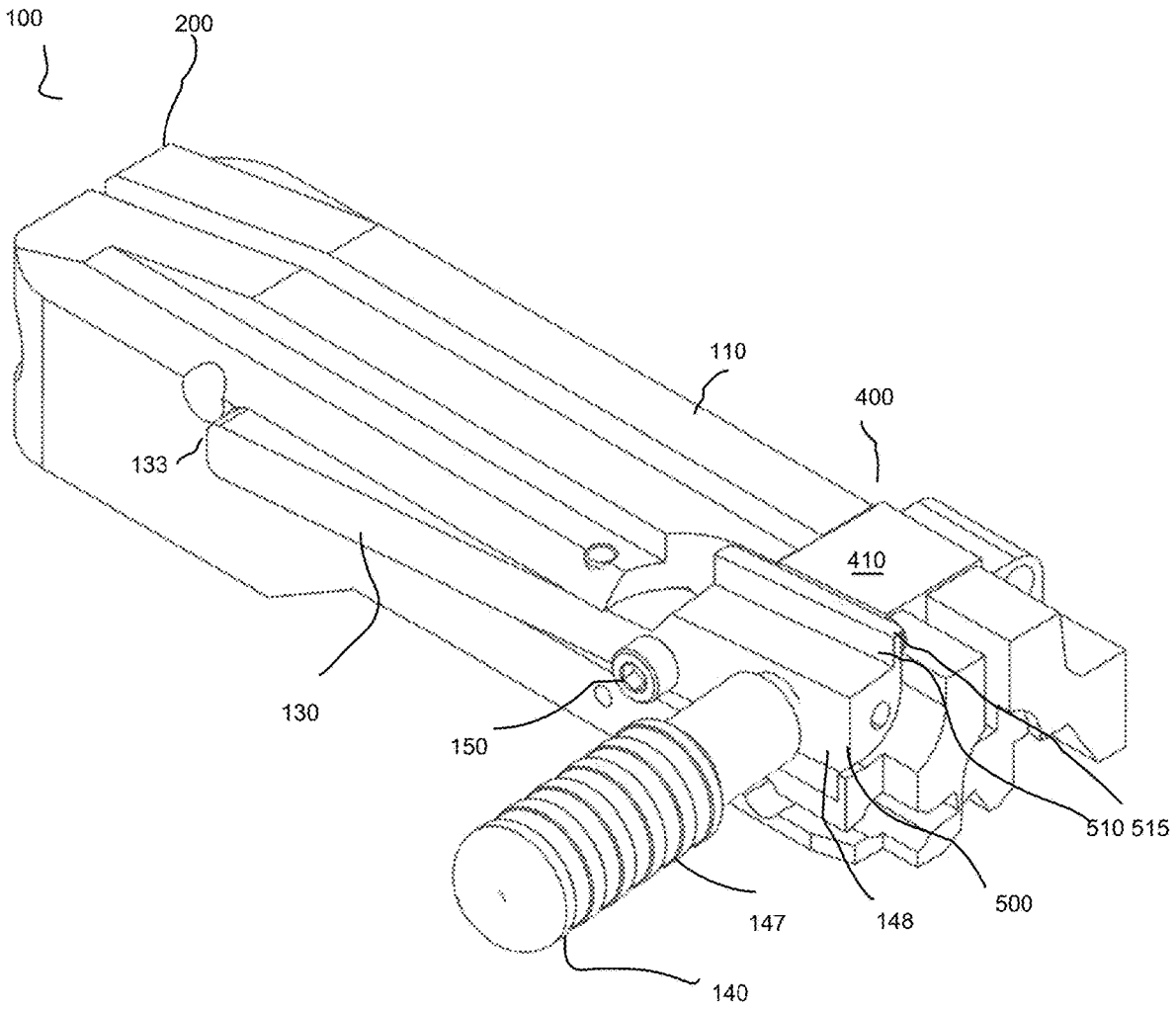
FIG. 10 illustrates a top perspective view of a bolt lock safety device, according to an alternate embodiment of the present invention.
Figure 11:
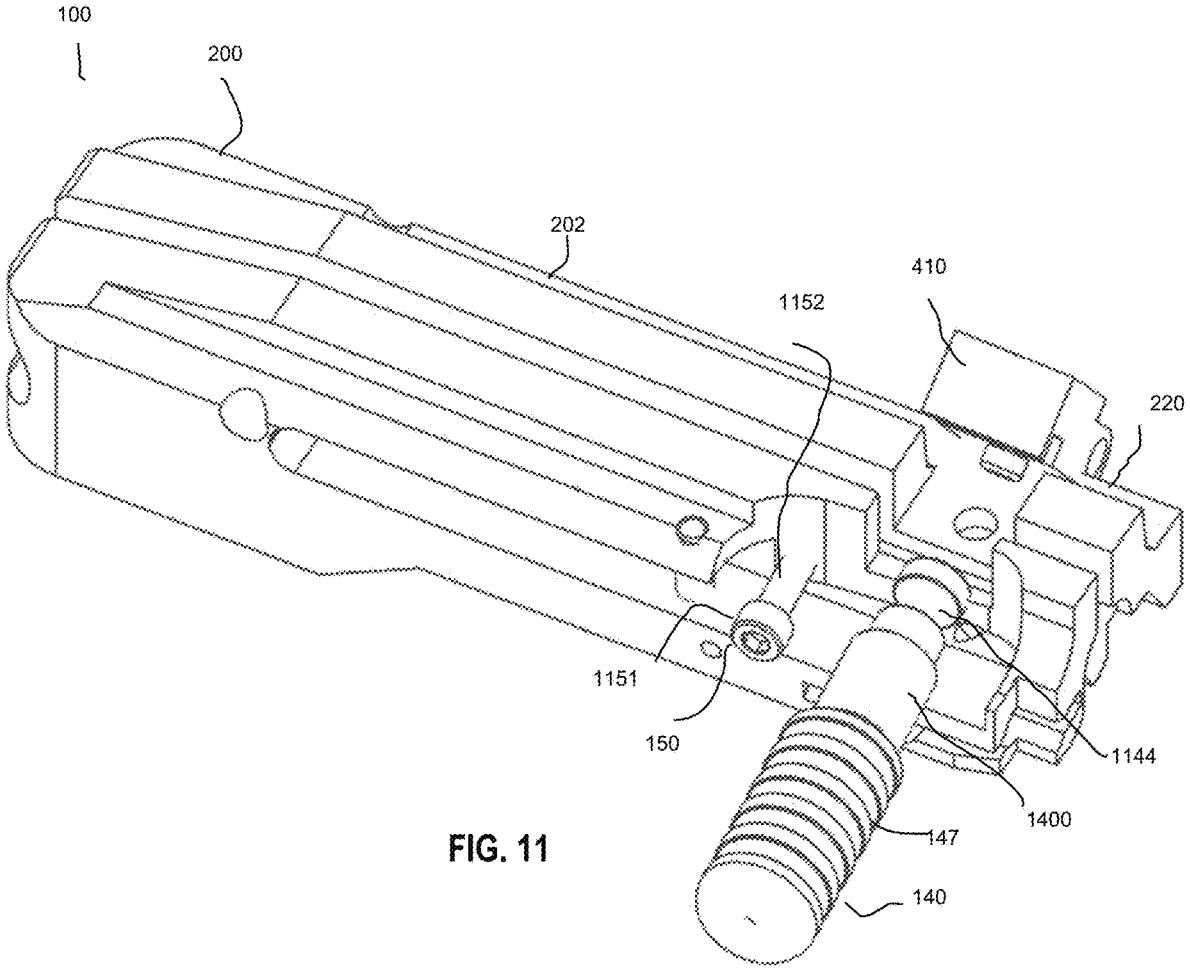
FIG. 11 illustrates a top perspective view of a bolt lock safety device with the guide rod partially removed and the bolt lock removed, according to an alternate embodiment of the present invention.
Figure 12:
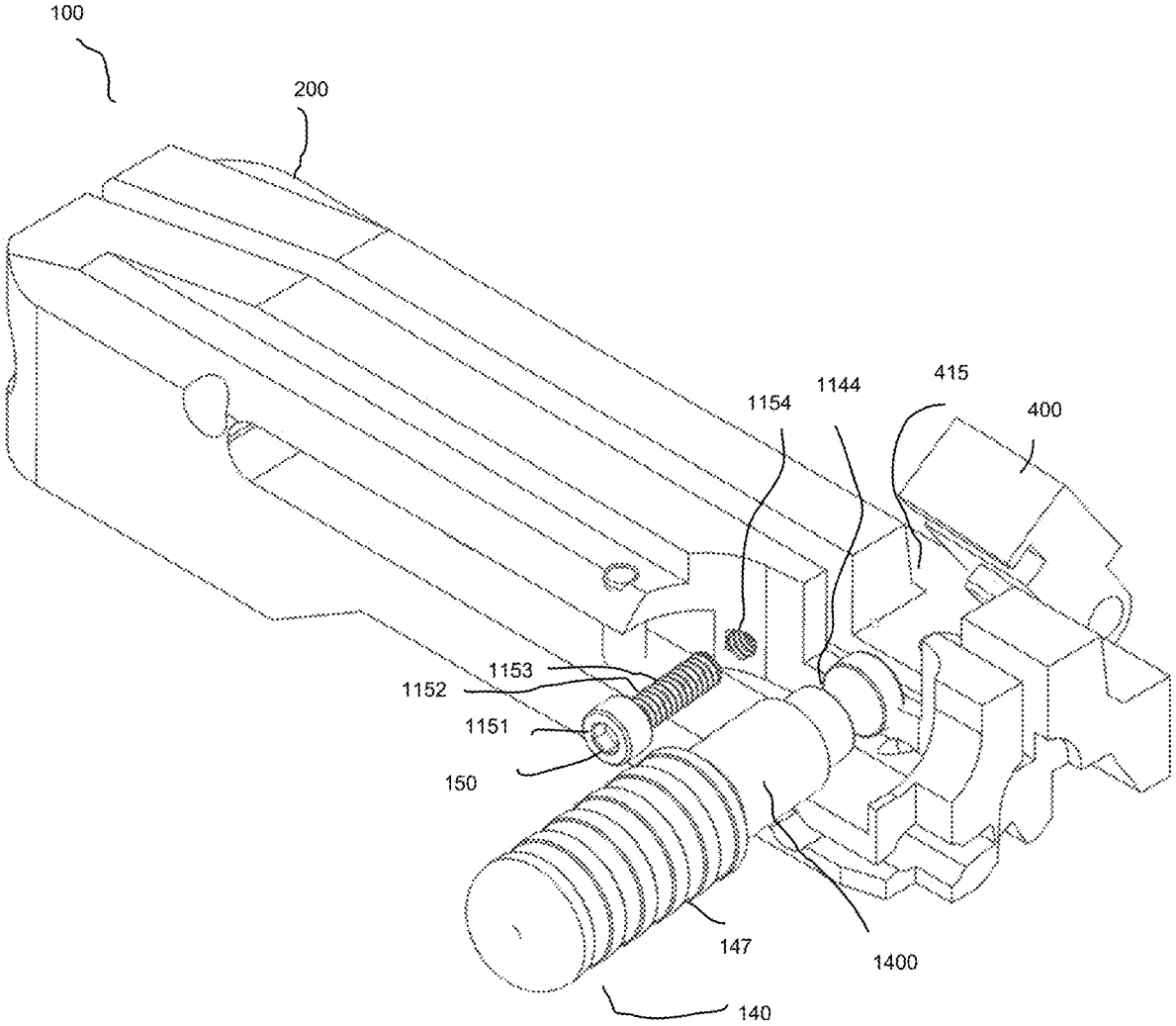
FIG. 12 illustrates a top perspective view of a bolt lock safety device with the guide rod partially removed, the bolt lock removed, and the lock screw partially removed, according to an alternate embodiment of the present invention.
Figure 13:
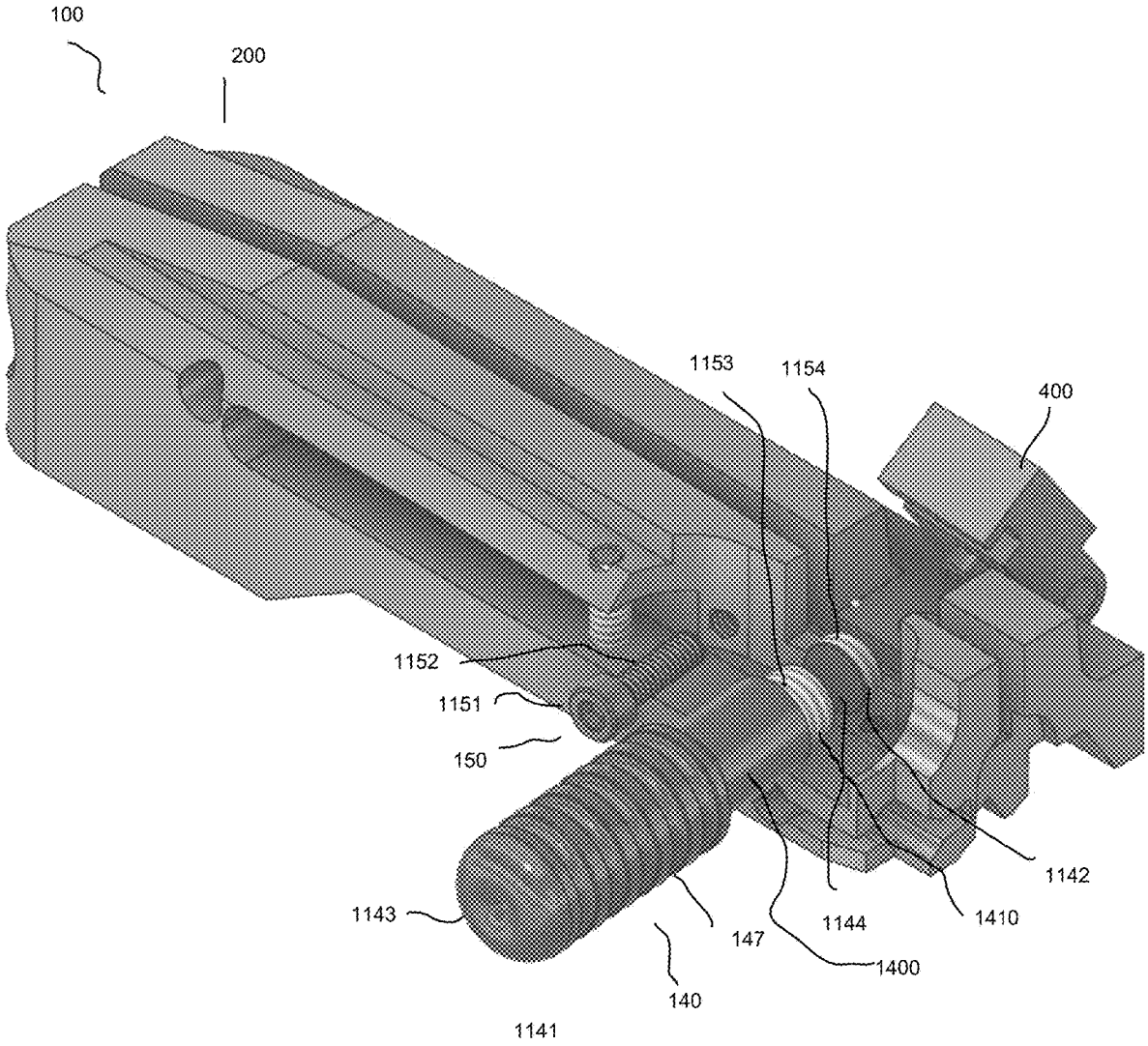
FIG. 13 illustrates a top perspective shaded view of a bolt lock safety device, with the bolt lock removed, according to the embodiment shown in FIG. 12.
Figure 14:
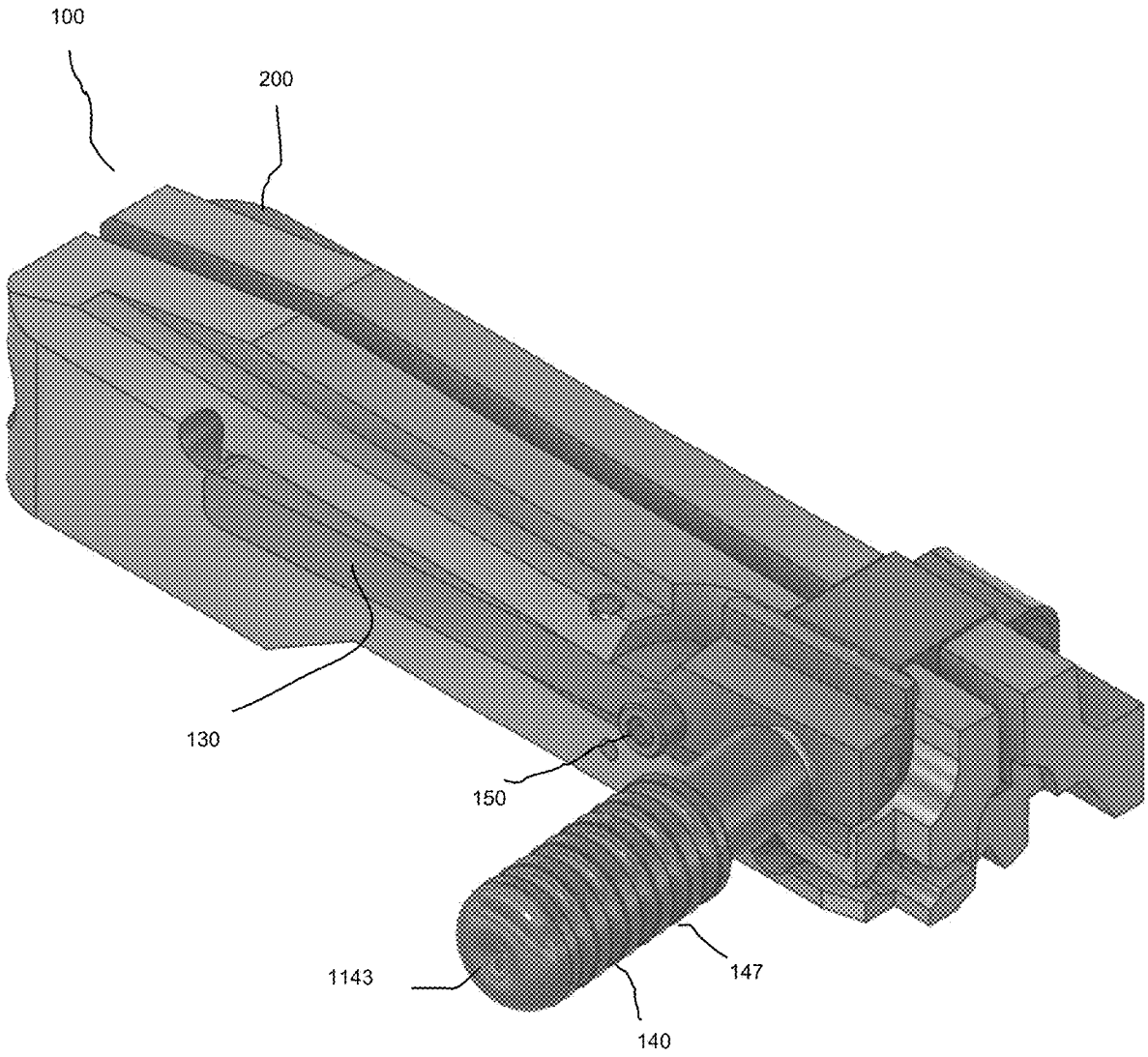
FIG. 14 illustrates a top perspective shaded view of a bolt lock safety device in lock position, according to an alternate embodiment of the present invention.

An alternative embodiment of bolt lock safety device 100, in various stages of assembly and locking positions is shown in FIGS. 7-14). As can be seen in FIG. 7, an embodiment of the bolt lock safety device 100 includes an alternative placement of the locking screw, or lock safety screw 150 is shown in alternative position 1150 rearwards of handle and lock adjuster and does not have to longitudinally traverse the lock adjuster 140. Lock adjuster 140 may be screwed down to optionally lock the adjustable bolt lock 130 into unlocked position. Lock safety screw 150 may be screwed into bolt 200 main body to lock position of bolt lock 130. Lock adjuster may also include surface features or texture 147 such as ribbing or cross-hatch, or otherwise. Lock adjuster body 1400 may include a first threaded portion 1410 closest to head 1141, and a further threaded portion 1142 towards tip 1143, with a smooth portion 1144 to prevent the lock adjuster from being completely unscrewed and removed from bolt lock body. Lock safety screw 150 may include mushroom head 1151 with female hex recess, or other screwing means to allow for rotation and setting the lock into the bolt. Lock safety screw body 1152 may include threads 1153 to mate with complementary threads 1154 in the bolt 200, and may obviate the need for a return spring.

Bolt lock 130 may also include a face 133 at blocking point 132 near end 139 of bolt lock 130 to interact with the bolt 200 at bolt lock longitudinal recess 110 interface 111. Face 133 is preferably shaped with curvilinear or rounded edges to provide a snug fit, however, typical wear can often impede the clocking action of the bolt lock with continued use. Therefore, a flat shape 135 with corners 134 is preferred. This flat and corners embodiment of the bolt lock 130 end 139 better disperses the force against bolt 200 with contacts at corners 134 simultaneously directing force upwards and downwards against bolt. Distance between end 139 and firing pin slot may include a thin structure 340, but the material of the bolt 200 should prevent breakage.

In the alternative embodiments, guide rod cavity 220 may be improved with the guide rod 310 including portions of the top surface tab 202 in a combined guide rod 400. Guide rail or guide rod 400 includes guide rod block 410 with lower recess 420 serving as aperture or otherwise allowing of the cavity to remain unimpeded. Guide rod block 410 also includes a dimple 411 on lower surface 412 of block 400 to complementarily mate with a cavity 415 in top 201 of block 200. Altogether, this guide rod 400 with block and dimple/cavity feature help fix position of guide rod block 410 relative bolt 200. This prevents the guide rod from passing through or outwards, and prevent jamming against the receiver.

Locking adjuster 130 may be set into bolt 200 through bolt lock 130 through receiving block 500 feature in bolt lock 130, wherein the tip 148 of bolt lock extended upwards larger than height of recess 110. Receiving block 500 further may include a flat panel 510 set upwards from internal top corner edge 515 of receiving block 500. Falt panel 510 serves to keep the bolt lock relative and coupled with guide rails, so the feature catches on the guide rail of the receiver.

What is claimed:

1. A bolt lock safety device for a bolt in a receiver, the bolt lock safety device comprising:

a bolt comprising:

a bolt lock longitudinal recess sized to accommodate an adjustable bolt lock the adjustable bolt lock comprising:

a shape of a bar wherein the adjustable bolt lock further comprises a lock adjuster in threaded engagement with the bolt, wherein the bolt lock is pivotally coupled to the bolt and configured to impart a first rotation to the bar in a direction to extend beyond an outer surface of the receiver when the lock adjuster is engaged, and wherein the lock adjuster imparts a second rotation to the bar in another direction to be flush with a side surface of the bolt when the lock adjuster is disengaged.

2. The bolt lock safety device of claim 1, wherein the bolt further comprises a return spring cavity coupled at the proximal end of the bolt lock longitudinal recess.

3. The bolt lock safety device of claim 1, wherein the adjustable bolt lock is coupled to the bolt via a lock pivot pin.

4. The bolt lock safety device of claim 3, wherein the lock pivot pin is set transverse and within the bolt lock longitudinal recess, the lock pivot pin is set through a pivot pin lock aperture of the adjustable bolt lock and through a pivot pin bolt aperture of the bolt providing an axis to allow the adjustable bolt lock to rotate partially out of the bolt lock longitudinal recess when the lock adjuster is engaged.

5. The bolt lock safety device of claim 1, wherein the bar further comprises a safety screw hole adapted to receive a lock safety screw.

6. The bolt lock safety device of claim 5, wherein the safety screw hole is set rear of the bolt lock adjuster.

7. The bolt lock safety device of claim 5, wherein the safety the lock safety screw is coupled to complementary threads in the bolt.

8. The bolt lock safety device of claim 5, wherein the safety the lock safety screw comprises a mushroomed head.

9. The bolt lock safety device of claim 1, wherein the lock safety screw is removed from the lock adjuster, wherein the removal of the lock safety screw unlocks the adjustable bolt lock, and renders a semi-automatic firearm operable.

10. The bolt lock safety device of claim 1 wherein the adjustable bolt lock comprises a blot lock block portion wider than the bar.

11. The bolt lock safety device of claim 1 wherein the adjustable bolt lock comprises a flat panel along a top edge of the adjustable bolt lock.

12. The bolt lock safety device of claim 1 wherein the adjustable bolt lock comprises a flat end.

13. The bolt lock safety device of claim 12 wherein the flat end comprises corners to interact with the recess.

14. The bolt lock safety device of claim 1 wherein the bolt comprises a guide rail with a guide rail block serving as a top of the bolt.

15. The bolt lock safety device of claim 14 wherein the guide rail block comprises a lowered dimple adapted to set within a portion of the bolt.

16. A method for operating a semi-automatic firearm as a single-shot firearm comprising:

installing a bolt in the firearm, wherein the bolt comprises a bolt lock safety device, wherein the bolt lock safety device extends beyond a face of the bolt when engaged;

disengaging the bolt lock safety device by rotating the bolt lock safety device along a pivot pin axis so the bolt lock safety device no longer extends beyond the face of the bolt; and pulling a charging handle back to cause the bolt to move rearward exposing the firearm chamber to reload a cartridge.

17. The method of claim 16, wherein the bolt lock safety device stops the bolt from recoiling past a distance enough to expose a firearm chamber for the firearm to reload when engaged.

18. The method of claim 16, further comprising the step of securing the bolt lock safety device into a locked position extending beyond the face of the bolt by screwing the lock adjuster in a first direction until the adjustable bolt lock extends beyond a face of the bolt.

19. The method of claim 16, wherein the step of disengaging the adjustable bolt lock comprises unscrewing the lock adjuster in a second direction until the adjustable bolt lock is flush with a surface of the bolt.

20. The method of claim 16, further comprising the step of discharging the semi-automatic firearm thereby causing spring pressure from the lock return spring to pivot the adjustable bolt lock outwards forcing the adjustable bolt lock to contact a receiver preventing full recoil of the bolt.

* * * * *